US008981868B2

(12) United States Patent
Lin

(10) Patent No.: US 8,981,868 B2
(45) Date of Patent: Mar. 17, 2015

(54) BALUN PRINTED ON SUBSTRATE

(71) Applicant: Hon Hai Precision Industry Co., Ltd., New Taipei (TW)

(72) Inventor: Chao-Ho Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 94 days.

(21) Appl. No.: 13/924,648

(22) Filed: Jun. 24, 2013

(65) Prior Publication Data

US 2014/0247096 A1 Sep. 4, 2014

(30) Foreign Application Priority Data

Mar. 1, 2013 (TW) ..... 102107141 A

(51) Int. Cl.
*H01P 5/10* (2006.01)

(52) U.S. Cl.
CPC ..... *H01P 5/10* (2013.01)
USPC ..... 333/26; 333/25

(58) Field of Classification Search
USPC ..... 333/25–27, 237, 246
See application file for complete search history.

(56) References Cited

U.S. PATENT DOCUMENTS 6,683,510 B1 * 1/2004 Padilla ..... 333/25
2007/0139133 A1 * 6/2007 Kwon et al. ..... 333/33

* cited by examiner

*Primary Examiner* — An Luu
(74) *Attorney, Agent, or Firm* — Novak Druce Connolly Bove + Quigg LLP

(57) ABSTRACT

A balun includes an input port, a first output port, a second output port and a coupling microstrip group including an input line connected to the input port, a first output line connected to the first output port, a first coupling line, a second output line connected to the second output port and a second coupling line. The input line includes a first coupling section connected to the input port, a second coupling section opposite to the first coupling section and a connecting section connected between the first coupling section and the second coupling section. An unbalanced signal is transformed into a first balanced signal via coupling among the first coupling section, the first output line and the first coupling line. An unbalanced signal is transformed into a second balanced signal via coupling among the second coupling section, the second output line and the second coupling line.

14 Claims, 18 Drawing Sheets

BALUN PRINTED ON SUBSTRATE

BACKGROUND

1. Technical Field

The present disclosure relates to baluns, and more particularly to a balun printed on a substrate.

2. Description of Related Art

A balun is a device operable to convert between balanced and unbalanced lines for input and output in an electrical system and may be used in a communication apparatus, such as a set top box, to transform unbalanced broadcasting signals into balanced broadcasting signals. A typical prior art balun, such as low-temperature co-fired ceramic balun, is discretely mounted on a substrate. This balun is both bulky and expensive. Therefore, designing a balun, which has a small size and low cost, is a question for discussion.

Therefore, a need exists in the industry to overcome the described limitations.

BRIEF DESCRIPTION OF THE DRAWINGS

The details of the disclosure, both as to its structure and operation, can best be understood by referring to the accompanying drawing, in which like reference numbers and designations refer to like elements.

DETAILED DESCRIPTION

Figure 1:
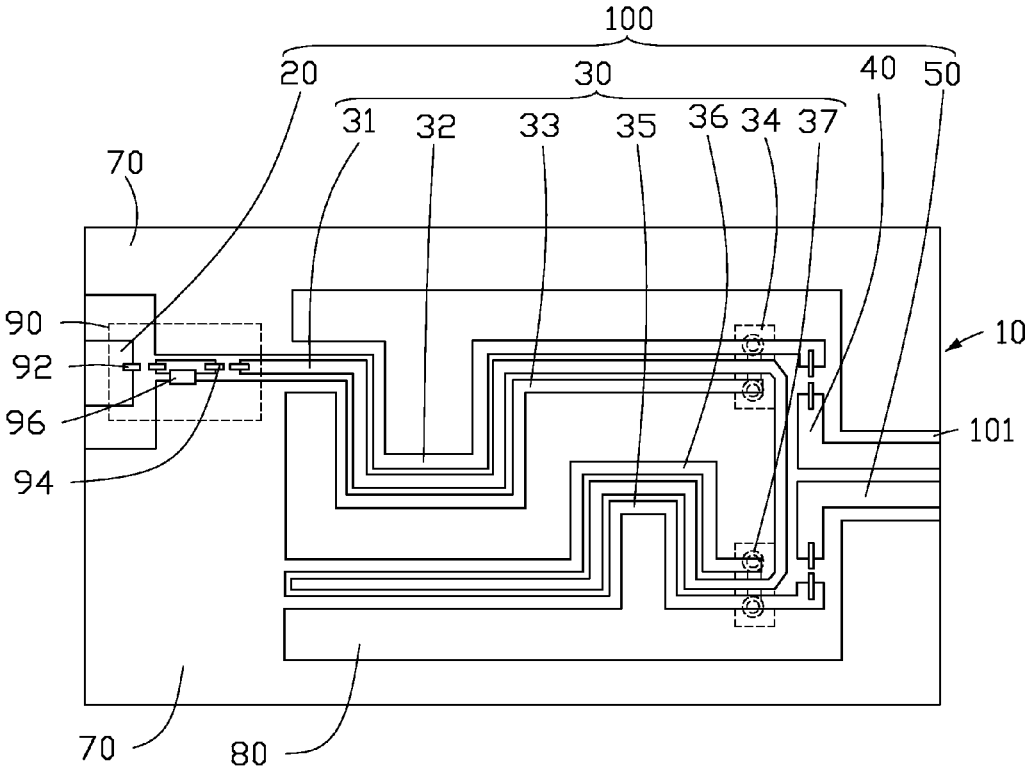
FIGS. 1-2 are schematic plan views of one embodiment of a balun formed on a first surface of a substrate in accordance with the present disclosure.

In FIG. 1, one embodiment of a balun 100 in accordance with the present disclosure is printed on a substrate 10 in a communication device and operable to transform an unbalanced signal into a first balanced signal and a second balanced signal. The balun 100 includes an input port 20 operable to input the unbalanced signal, a coupling microstrip group 30, a first output port 40 operable to output the first balanced signal and a second output port 50 operable to output the second balanced signal. The substrate 10 includes a first surface 101 and a second surface 102 (shown in FIG. 3). The substrate 10 may be formed as a single layer PCB or a multi-layer PCB. In this embodiment, the input port 20, the coupling microstrip group 30, the first output port 40 and the second output port 50 are coplanar with each other and printed on the first surface 101 of the substrate 10. A ground layer 70 and a clearance area 80 are formed on the first surface 101 of the substrate 10. The clearance area 80 is an insulative area surrounded by the ground layer 70. The input port 20, the coupling microstrip group 30, the first output port 40 and the second output port 50 are arranged in the clearance area 80.

The coupling microstrip group 30 is connected between the input port 20 and the first and second output ports 40 and 50 to transform the unbalanced signal into the first and second balanced signals. The input port 20 is located at one side of the coupling microstrip group 30, and the first and second output ports 40, 50 are located at the other side of the coupling microstrip group 30 and opposite the input port 20. The coupling microstrip group 30 includes an input line 31, a first output line 32 connected to the first output port 40, a first coupling line 33, a second output line 35 connected to the second output port 50 and a second coupling line 36.

In other embodiments, the coupling microstrip group 30 may be distributed on different layers of the substrate 10 formed as the multi-layer PCB. For example, the substrate 10 includes a first layer, on which the input line 31 is arranged, a second layer, on which the first and second output lines 32, 35 are arranged, and a third layer, on which the first and second coupling lines 33, 36 are arranged.

Figure 2:
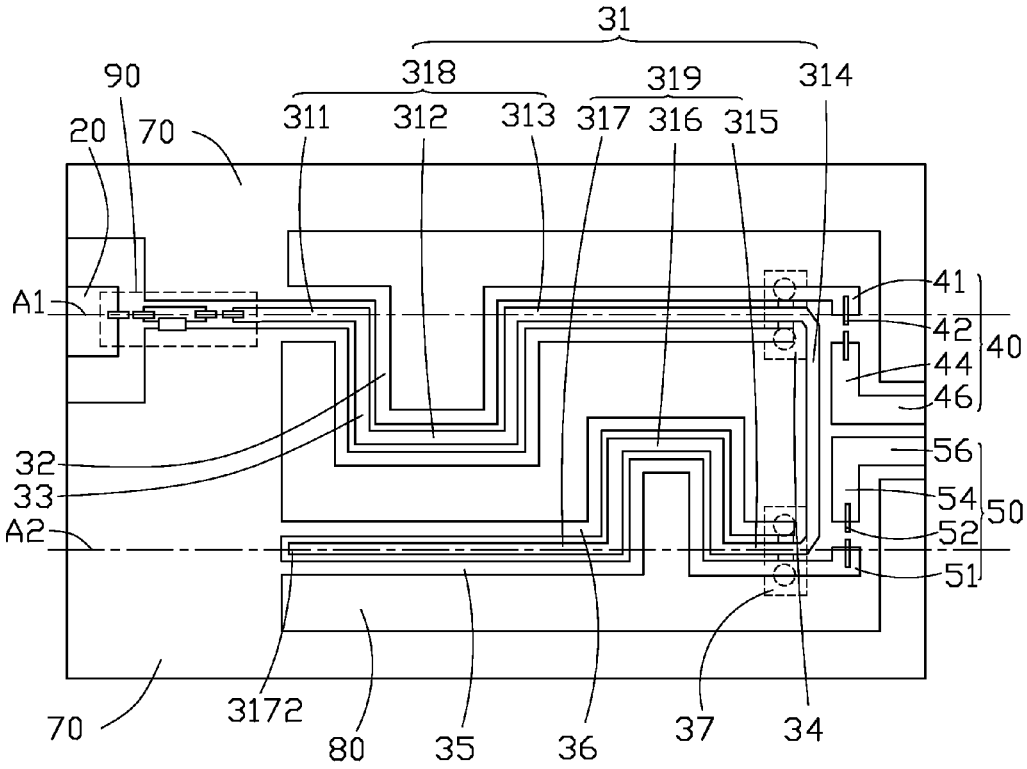

In FIG. 2, the input line 31 includes a first coupling section 318, a second coupling section 319 opposite to the first coupling section 318 and a connecting section 314 connected between the first coupling section 318 and the second coupling section 319. The first coupling section 318 is connected between the input port 20 and the connecting section 314. The first output line 32 and the first coupling line 33 are respectively located at two sides of the first coupling section 318. One end of the first coupling line 33 is electrically connected to the first output line 32. The second output line 35 and the second coupling line 36 are respectively located at two sides of the second coupling section 319. One end of the second coupling line 36 is electrically connected to the second output line 35.

The first output line 32, the second output line 35, the first coupling line 33 and the second coupling line 36 are grounded by extending from the ground layer 70 into the clearance area 80. The coupling microstrip group 30 includes four grounding junctions G1, G2, G3 and G4 distributed close to the input port 20. The grounding junction G1 is formed between the first output line 32 and the ground layer 70. The grounding junction G2 is formed between the first coupling line 33 and the ground layer 70. The grounding junction G3 is formed between the second coupling line 36 and the ground layer 70. The grounding junction G4 is formed between the second output line 35 and the ground layer 70. The connecting section 314 is arranged close to the first and second output ports 40, 50. That is, the four grounding junctions G1, G2, G3 and G4 are opposite to the connecting section 314.

The first output line 32 and the second output line 35 are respectively located at two opposite sides of the input line 31. The first output line 32 extends beside and along the first coupling section 318. The second output line 35 extends beside and along the second coupling section 319. The first coupling line 33 and the second coupling line 36 are located between the first coupling section 318 and the second coupling section 319. The first coupling line 33 extends beside and along the first coupling section 318. The second coupling line 36 extends beside and along the second coupling section 319. In this embodiment, the first coupling line 33, the first output line 32 and the first coupling section 318 are parallel with each other. The second coupling line 36, the second output line 35 and the second coupling section 319 are parallel with each other.

Figure 3:
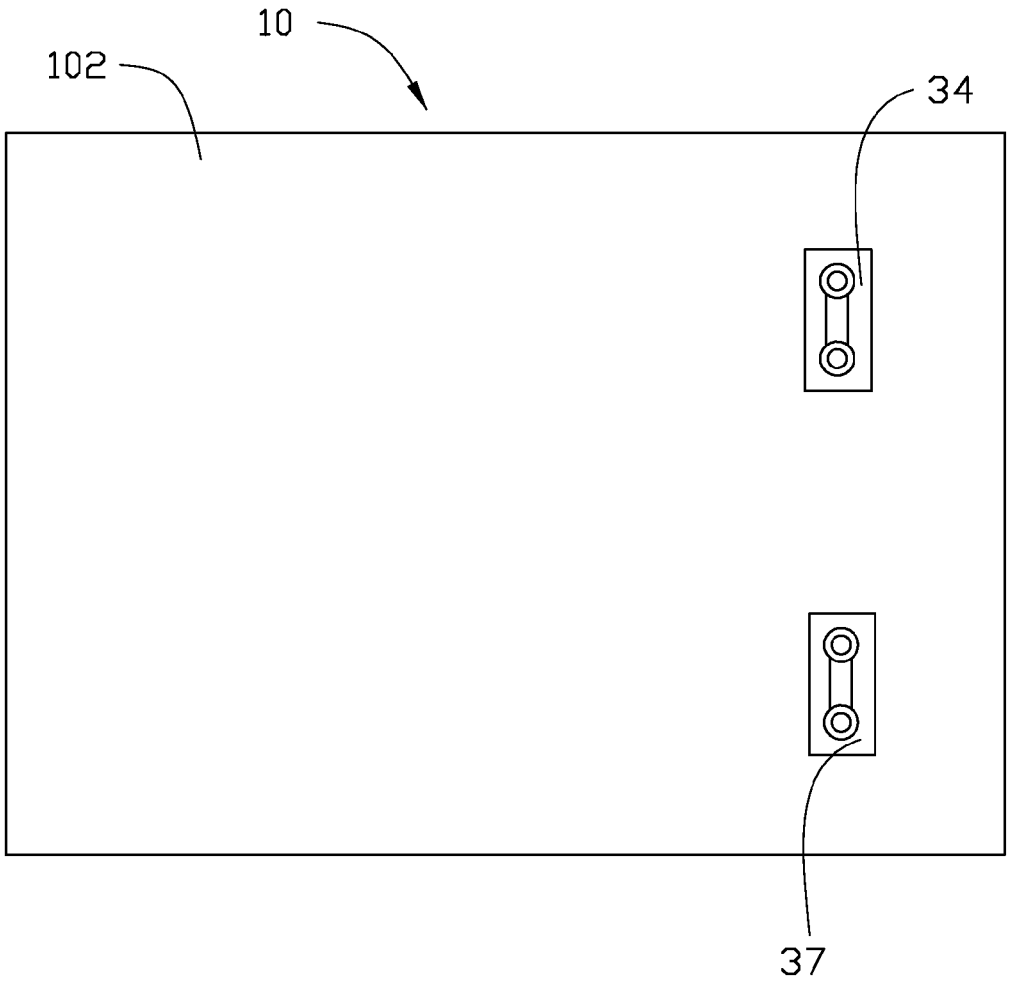
FIG. 3 is a schematic plan view of the balun of FIG. 1 formed on a second surface of a substrate.

In FIG. 3, in this embodiment, the balun 100 further includes a first connecting part 34 and a second connecting part 37 formed on the second surface 102 of the substrate 10 and close to the connecting section 314 of the input line 31. The first connecting part 34 is electrically connected to the first coupling line 33 and the first output line 32 by two conducting holes extending from the first surface 101 to the second surface 102. The second connecting part 37 is operable to be electrically connected between the second coupling line 36 and the second output line 35 by two conducting holes extending between the first surface 101 and the second surface 102.

The first output line 32 is electrically connected to the first output port 40.

The second output line 35 is electrically connected to the second output port 50. The input line 31 is operable to receive and transmit the unbalanced signal. The unbalanced signal is transformed into the first balanced signal via coupling among the first coupling section 318, the first output line 32 and the first coupling line 33. The first balanced signal is transmitted to the first output port 40 from the first output line 32. The unbalanced signal is transformed into the second balanced signal via coupling among the second coupling section 319, the second output line 35 and the second coupling line 36. The second balanced signal is transmitted to the second output port 50 from the second output line 35.

The first coupling section 318 includes a first straight portion 311, a first wandering portion 312 and a second straight portion 313 connecting with each other in turn. The first straight portion 311 is adjacent and connected to the input port 20. The second straight portion 313 is adjacent and connected to the connecting section 314. The second coupling section 319 includes a third straight portion 315, a second wandering portion 316 and a fourth straight portion 317 connecting with each other in turn. The third straight portion 315 is adjacent and connected to the connecting section 314. The fourth straight portion 317 includes a free end 3172 formed away from the connecting section 314. The first wandering portion 312 is opposite to the fourth straight portion 317. The second wandering portion 316 is opposite to the second straight portion 313. The first straight portion 311 and the second straight portion 313 are collinear and lie on a same straight line A1. The third straight portion 315 and the fourth straight portion 317 are collinear and lie on a same straight line A2 parallel with the straight line A1 and perpendicular to the connecting section 314.

The balun 100 further includes an input matching circuit 90 formed between the input port 20 and the input line 31 and operable to improve an input return loss for obtaining a better stability for the balun 100. The input matching circuit 90 includes a first capacitor 92, a second capacitor 94 and an inductor 96. The first capacitor 92 and the second capacitor 94 are connected with each other in series and located between the input port 20 and the input line 31. The input end of the first capacitor 92 is connected to the input port 20, and the output end of the first capacitor 92 is connected to the second capacitor 94. The inductor 96 has two ports, one of which is connected to the output end of the first capacitor 92, and the other one is connected to the ground layer 70.

The first output port 40 includes a first connecting end 41, a first output capacitor 42, a first middle section 44 and a first output section 46 in turn. The first connecting end 41 is connected to the first output line 32. The first output capacitor 42 is connected between the first connecting end 41 and the first middle section 44. The first connecting end 41 and the first middle section 44 are collinear, and the first output section 46 is perpendicular to the first middle section 44. The second output port 50 includes a second connecting end 51, a second output capacitor 52, a second middle section 54 and a second output section 56 in turn. The second connecting end 51 is connected to the second output line 35. The second output capacitor 52 is connected between the second connecting end 51 and the second middle section 54. The second connecting end 51 and the second middle section 54 are collinear, and the second output section 56 is perpendicular to the second middle section 54. The first output capacitor 42 and the second output capacitor 52 are operable to improve insertion losses of the first output port 40 and the second output port 50. The first output port 40 is formed as L-shaped and mirror-symmetrical to the second output port 50. The first connecting end 41, the first middle section 44, the second connecting end 51 and the second middle section 54 are collinear and lie on a same straight line A3, shown in FIG. 7.

Figure 4:
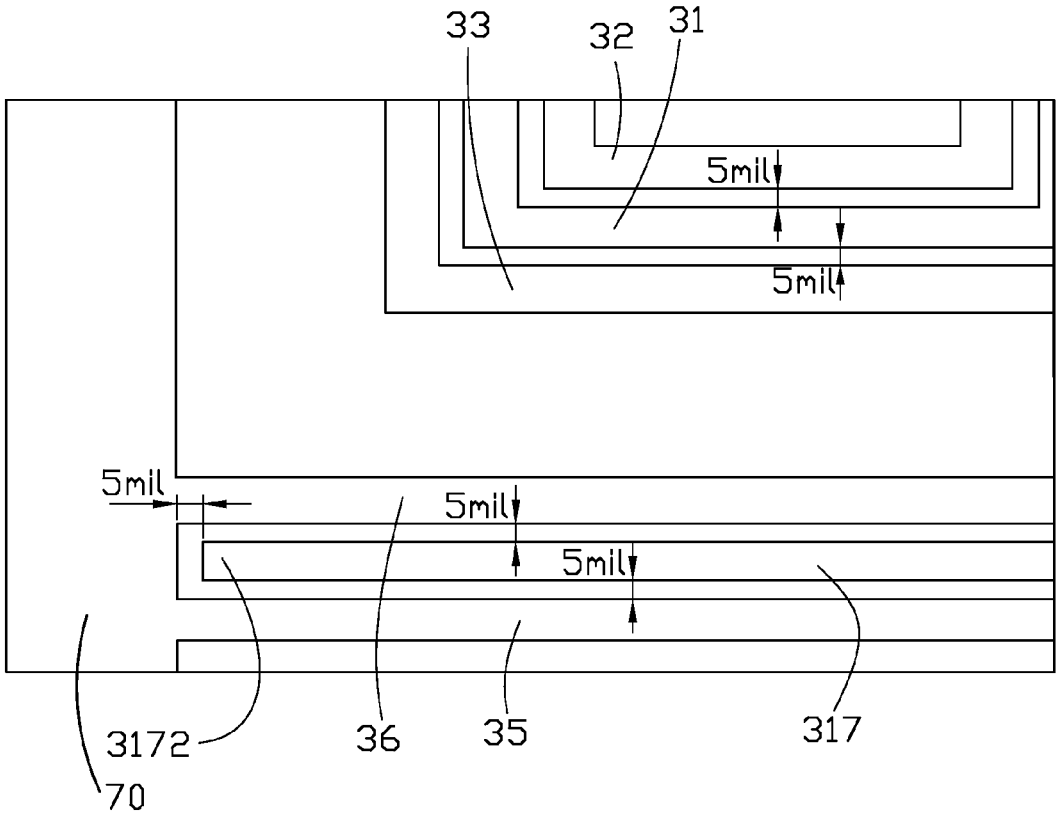
FIGS. 4-14 are schematic plan views illustrating dimensions of the balun of FIG. 1.
Figure 5:
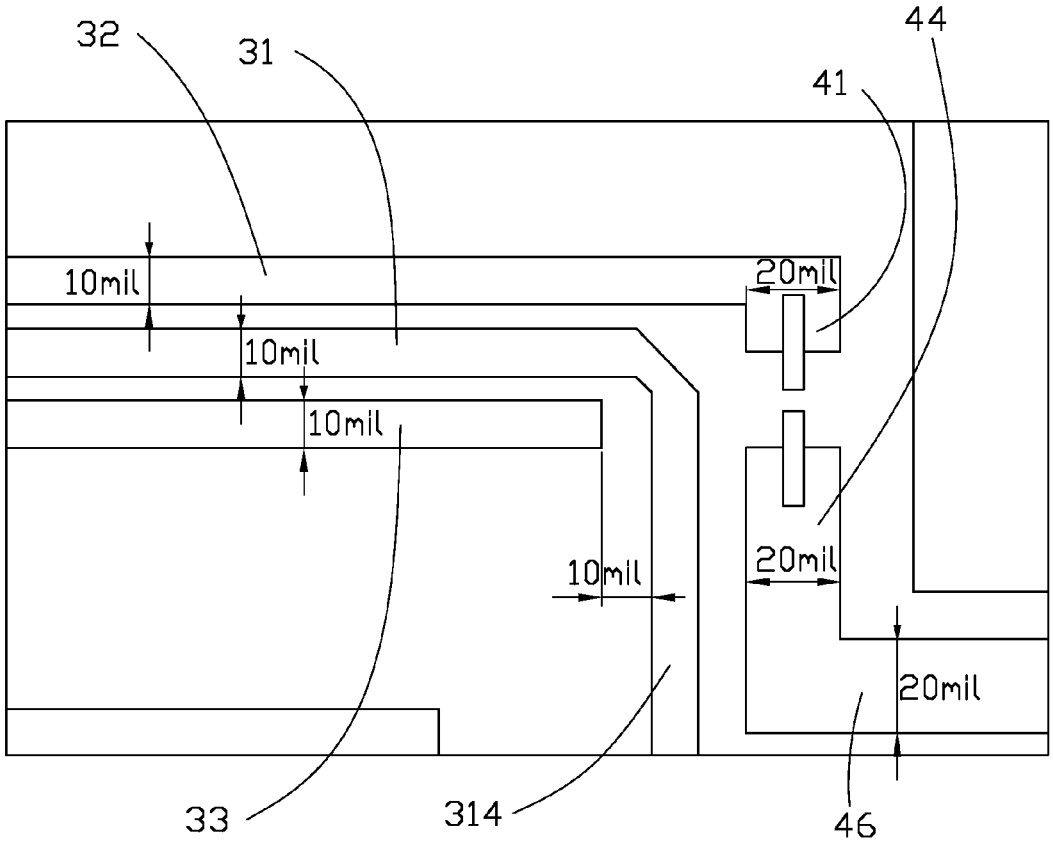

FIGS. 4-14 are schematic plan views illustrating dimensions of the balun 100. In FIG. 4, distance between the input line 31 and the first output line 32 is 5 mil. Distance between the input line 31 and the first coupling line 33 is 5 mil. Distance between the input line 31 and the second output line 35 is 5 mil. Distance between the input line 31 and the second coupling line 36 is 5 mil. A smallest distance between the free end 3172 of the input line 31 and the ground layer 70 is 5 mil. In FIG. 5, widths of the input line 31, the first output line 32 and the first coupling line 33 are all 10 mil. A smallest distance between the first coupling line 33 and the connecting section 314 is 10 mil. Widths of the first connecting end 41, the first middle section 44 and the first output section 46 are all 20 mil.

Figure 6:
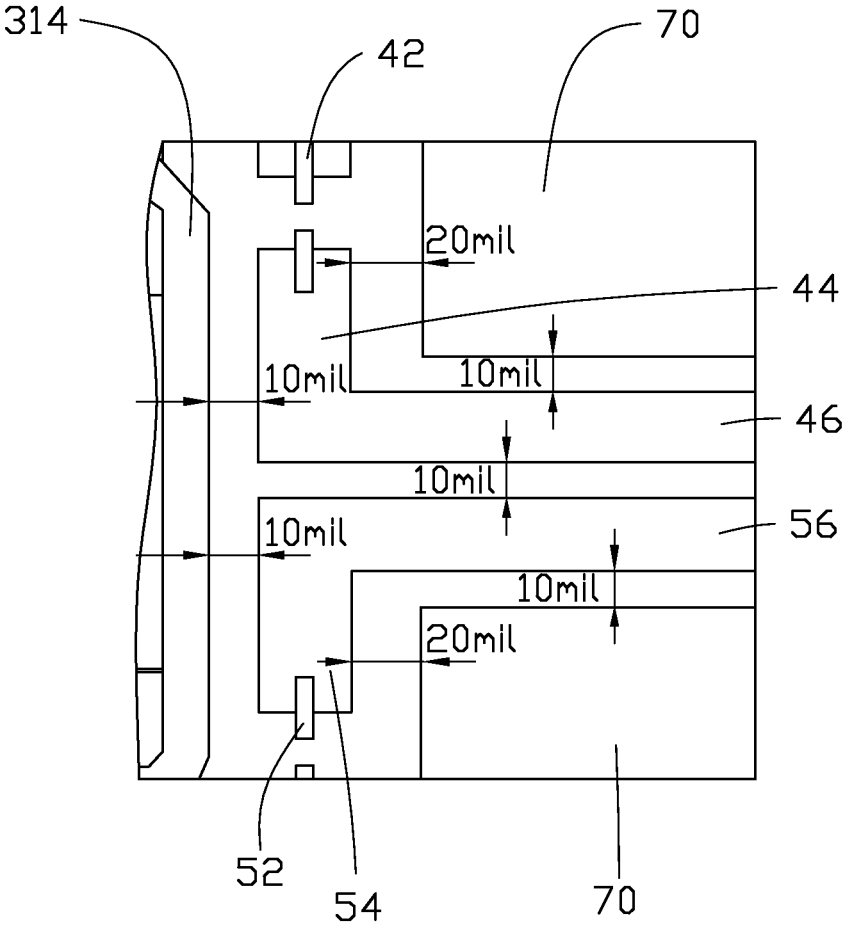

In FIG. 6, distance between the first middle section 44 of the first output port 40 and the connecting section 314 and distance between the second middle section 54 of the second output port 40 and the connecting section 314 are all 10 mil. Distance between the first output section 46 and the second output section 56 is 10 mil. Distance between the first middle section 44 and the ground layer 70 and distance between the second middle section 54 and the ground layer 70 are all 20 mil. Distance between the first output section 46 and the ground layer 70 and distance between the second output section 56 and the ground layer 70 are all 10 mil.

Figure 7:
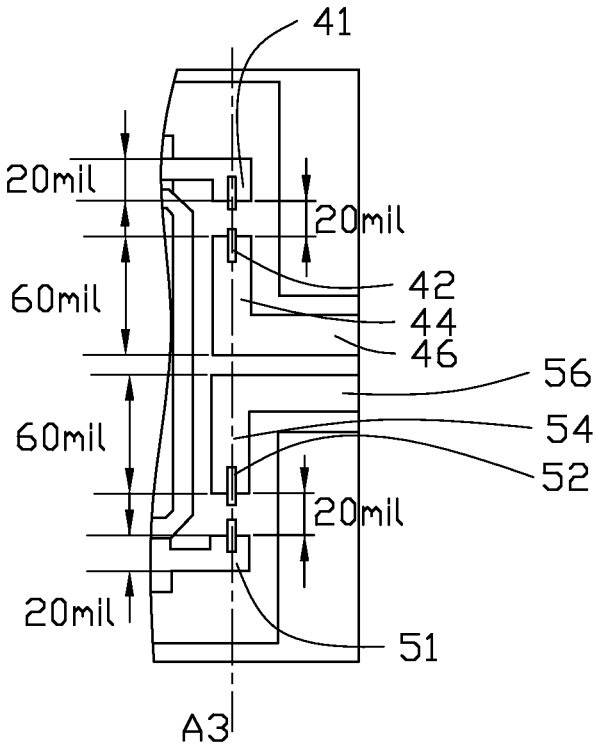

In FIG. 7, length of the first connecting end 41 along the straight line A3 is 20 mil and equal to that of the second connecting end 51. The first connecting end 41 and the second connecting end 51 are formed in square shapes. Distance between the first connecting end 41 and the first middle section 44 and distance between the second connecting end 51 and the second middle section 54 are all 200 mil. Length of the first middle section 44 along the straight line A3 is 60 mil and equal to that of the second middle section 54.

Figure 8:
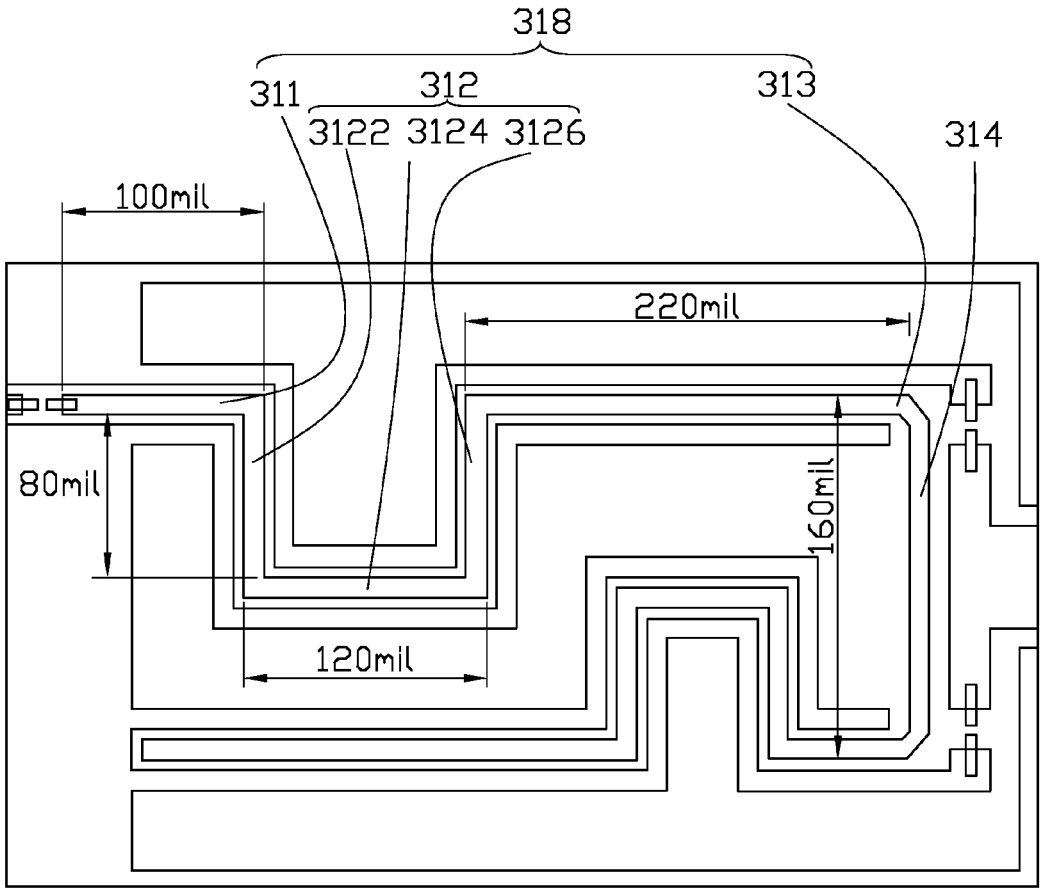

In FIG. 8, length of the first straight portion 311 is 100 mil. Length of the second straight portion 313 is 220 mil. Length of the connecting section 314 is 163 mil. The first wandering portion 312 includes a first section 3122, a second section 3124 and a third section 3126 in turn. The second section 3124 is parallel with the first and second straight portions 311, 313 and perpendicularly connected between the first section 3122 and the second section 3124 parallel with each other. Length of the first section 3122 is 80 mil and equal to that of the third section 3126. Length of the second section 3124 is 120 mil.

Figure 9:
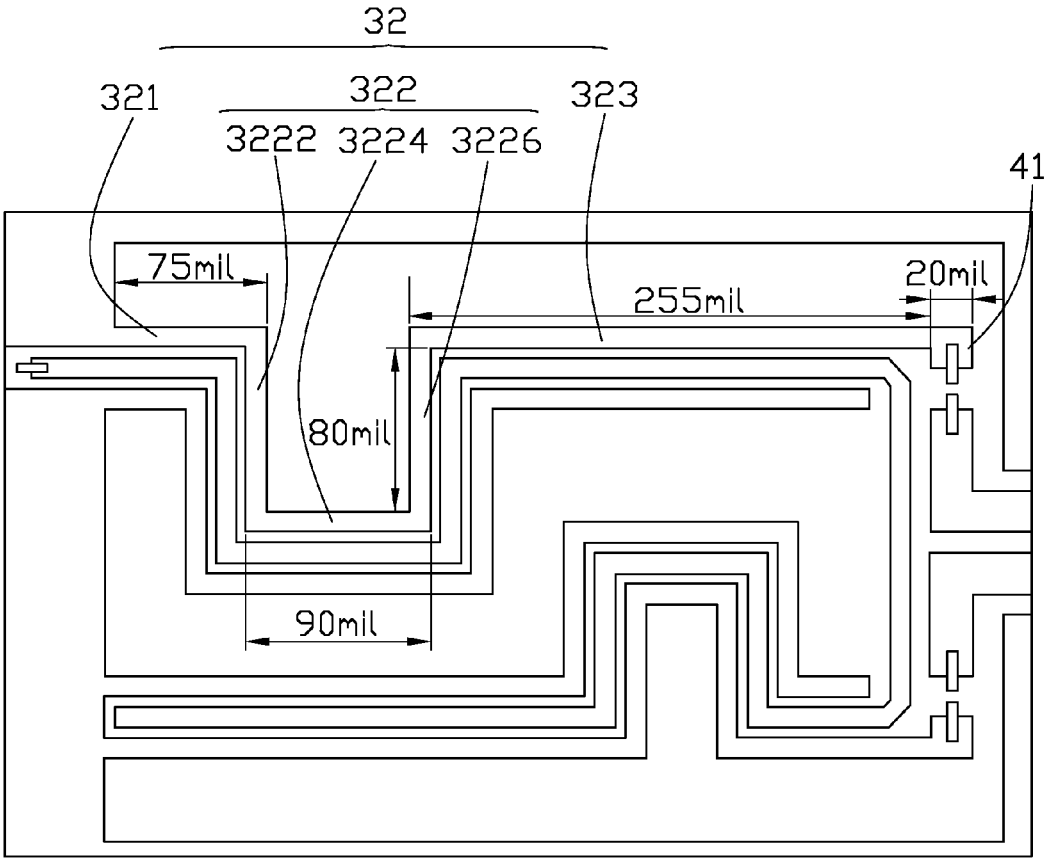

In FIG. 9, the first output line 32 includes a first straight portion 321, a first wandering portion 322 and a second straight portion 323 connecting with each other in turn. The first output line 32 has a similar shape with the input line 31. The first wandering portion 322 includes a first section 3222, a second section 3224 and a third section 3226 in turn. The second section 3224 is parallel with the first and second straight portions 321, 323 and perpendicularly connected between the first section 3222 and the second section 3224 parallel with each other. Length of the first straight portion 321 is 75 mil. Length of the second straight portion 323 is 255 mil. Length of the first section 3222 is 80 mil and equal to that of the third section 3226. Length of the second section 3224 is 90 mil.

Figure 10:
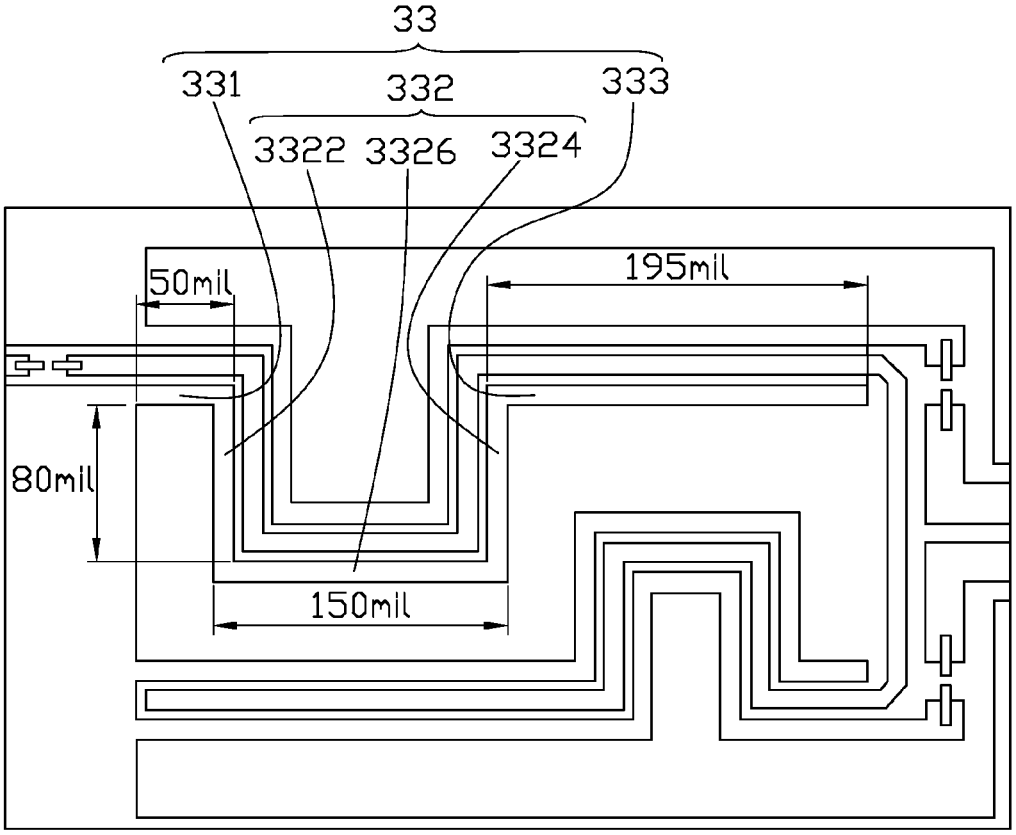

In FIG. 10, the first coupling line 33 includes a first straight portion 331, a first wandering portion 332 and a second straight portion 333 connecting with each other in turn. The first coupling line 33 has a similar shape with the first coupling section 318 of the input line 31. The first wandering portion 332 includes a first section 3322, a second section 3324 and a third section 3326 in turn. The second section 3324 is parallel with the first and second straight portions 331, 333 and perpendicularly connected between the first section 3322 and the second section 3324. Length of the first straight portion 331 is 50 mil. Length of the second straight portion 333 is 195 mil. Length of the first section 3322 is 80 mil and equal to that of the third section 3326. Length of the second section 3324 is 150 mil.

Figure 11:
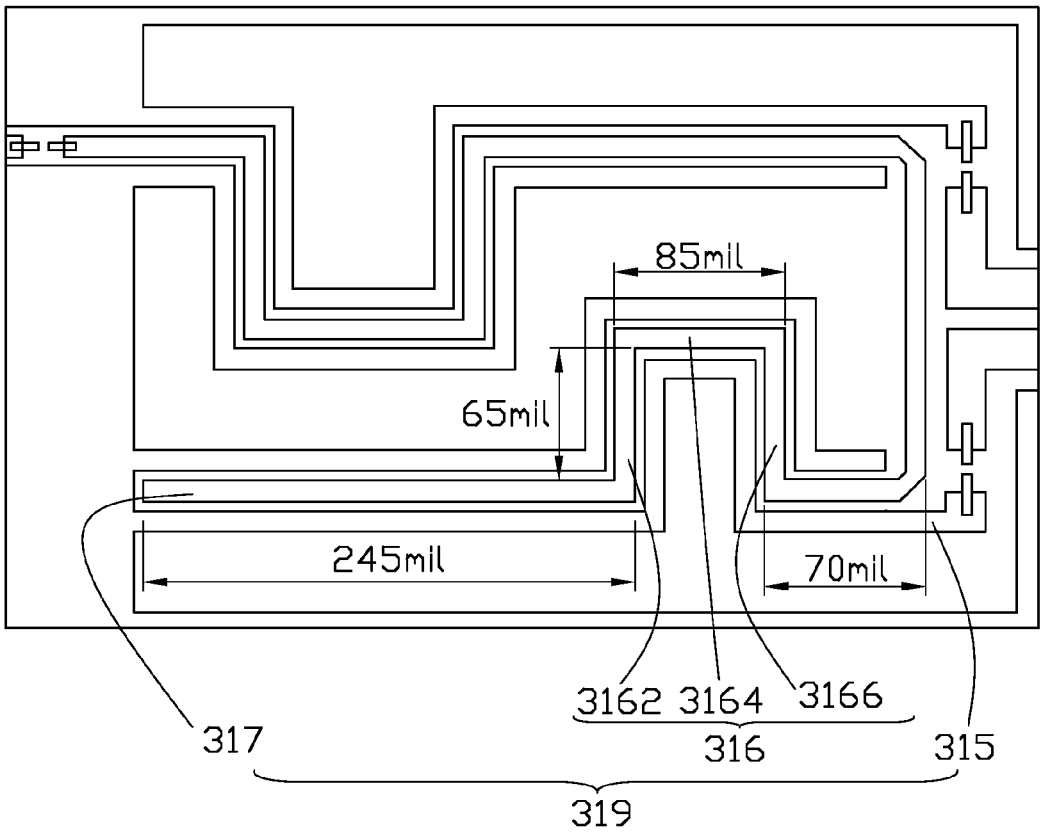

In FIG. 11, length of the third straight portion 315 of the second coupling section 319 is 70 mil. Length of the fourth straight portion 317 is 245 mil. The second wandering portion 316 includes a first section 3162, a second section 3164 and a third section 3166 in turn. The second section 3164 is parallel with the third and fourth straight portions 315, 317 and perpendicularly connected between the first section 3162 and the second section 3164 parallel with each other. Length of the first section 3162 is 65 mil and equal to that of the third section 3166. Length of the second section 3164 is 85 mil.

Figure 12:
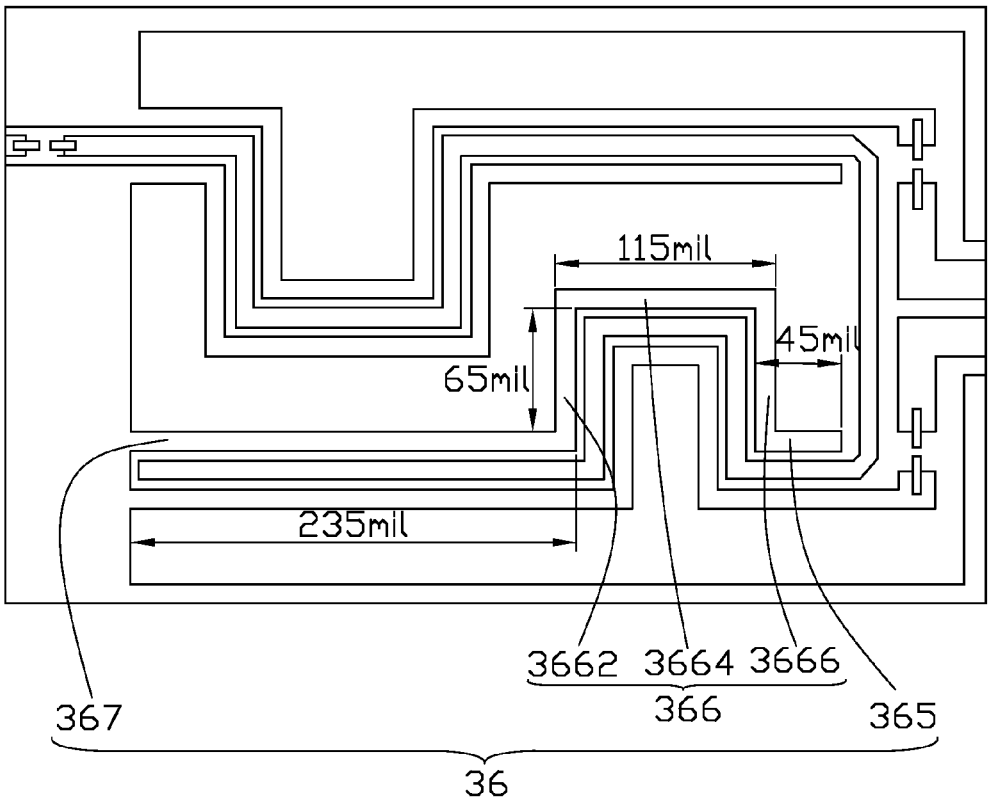

In FIG. 12, the second coupling line 36 includes a third straight portion 365, a second wandering portion 366 and a fourth straight portion 367 connecting with each other in turn. The second coupling line 36 has a similar shape with the second coupling section 319 of the input line 31. The second wandering portion 366 includes a first section 3662, a second section 3664 and a third section 3666 in turn. The second section 3664 is parallel with the third and fourth straight portions 365, 367 and perpendicularly connected between the first section 3662 and the second section 3664 parallel with each other. Length of the third straight portion 365 is 45 mil. Length of the fourth straight portion 367 is 235 mil. Length of the first section 3662 is 65 mil and equal to that of the third section 3666. Length of the second section 3664 is 115 mil.

Figure 13:
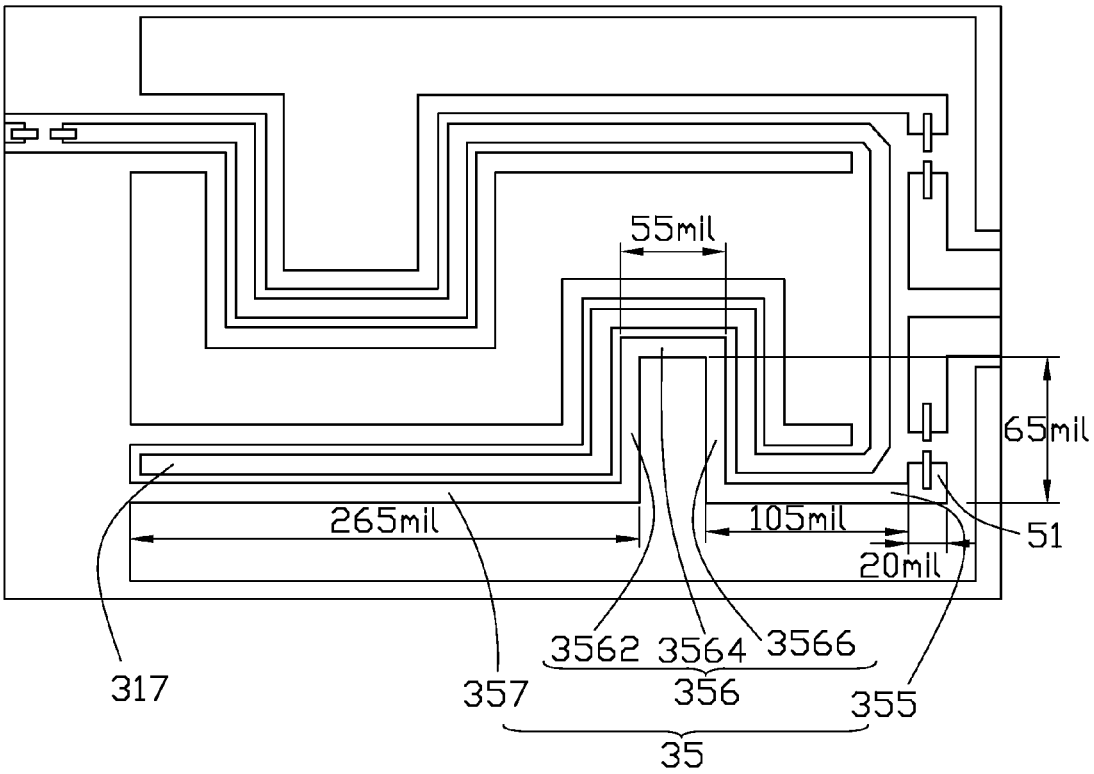

In FIG. 13, the second output line 35 includes a third straight portion 355, a second wandering portion 356 and a fourth straight portion 357 connecting with each other in turn. The second output line 35 has a similar shape with the second coupling section 319 of the input line 31. The second wandering portion 356 includes a first section 3562, a second section 3564 and a third section 3566 in turn. The second section 3564 is parallel with the third and fourth straight portions 355, 357 and perpendicularly connected between the first section 3562 and the second section 3564 parallel with each other. Length of the third straight portion 355 is 105 mil. Length of the fourth straight portion 357 is 265 mil. Length of the first section 3562 is 65 mil and equal to that of the third section 3566. Length of the second section 3564 is 55 mil.

Figure 14:
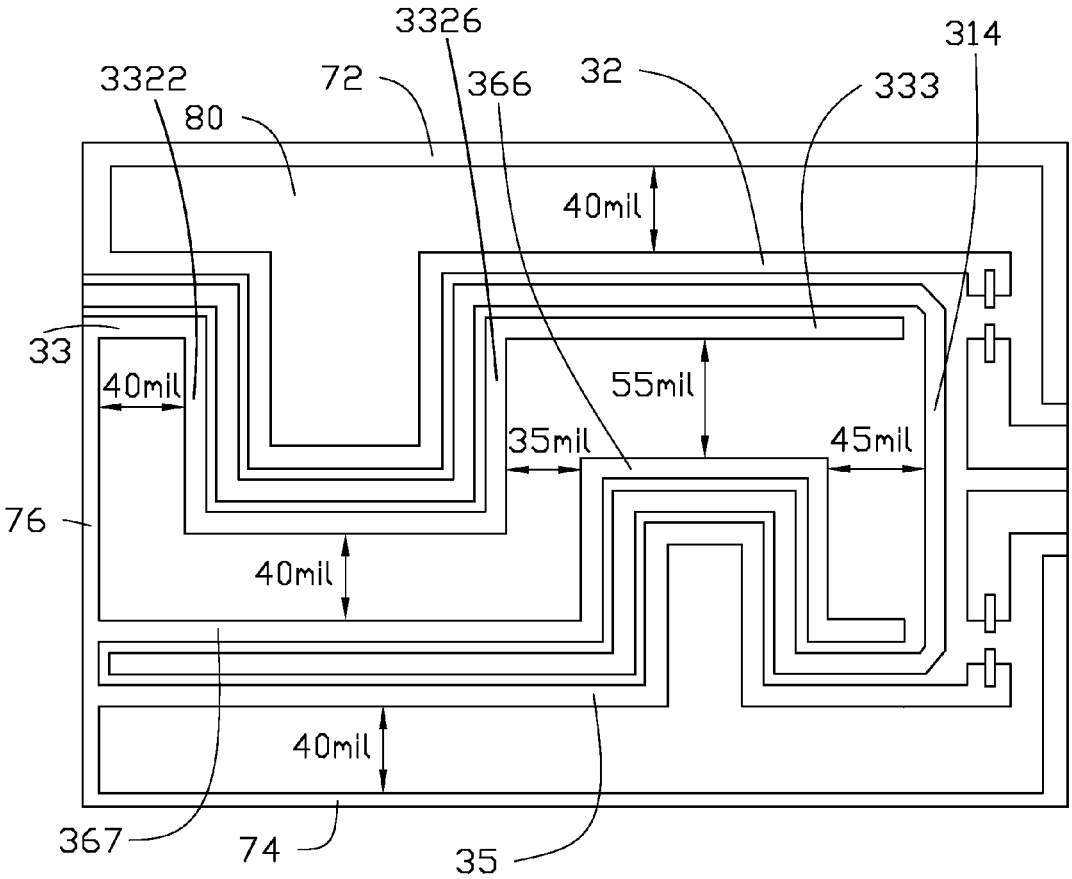

In FIG. 14, the clearance area 80 is surrounded by the ground layer 70. The ground layer 70 includes a first ground area 72 opposite to the first output line 32, a second ground area 74 opposite to the second output line 35 and a third ground area 76 close to the input port 20. A smallest distance between the first ground area 72 and the first output line 32 is 40 mil. A smallest distance between the second ground area 74 and the second output line 35 is 40 mil. A smallest distance between the first section 3322 of the first wandering portion 332 of the first coupling line 33 and the third ground area 76 is 40 mil. A smallest distance between the first coupling line 33 and the fourth straight portion 367 of the second coupling line 36 is 40 mil. A smallest distance between the third section 3326 of the first wandering portion 332 of the first coupling line 33 and the second wandering portion 366 of the second coupling line 36 is 35 mil. A smallest distance between the second straight portion 333 of the first coupling line 33 and the second wandering portion 366 is 55 mil. A smallest distance between the second wandering portion 366 and the connecting section 314 is 45 mil.

The present disclosure enables the balun 100 to cover radio frequency bands between 0.95 GHz-2.15 GHz. Lengths of the first coupling section 318, the second coupling section 319, the first output line 32, the first coupling line 33, the second output line 35 and the second coupling line 36 are substantially one-fourth (¼) of a working wavelength of the balun 100.

Figure 15:
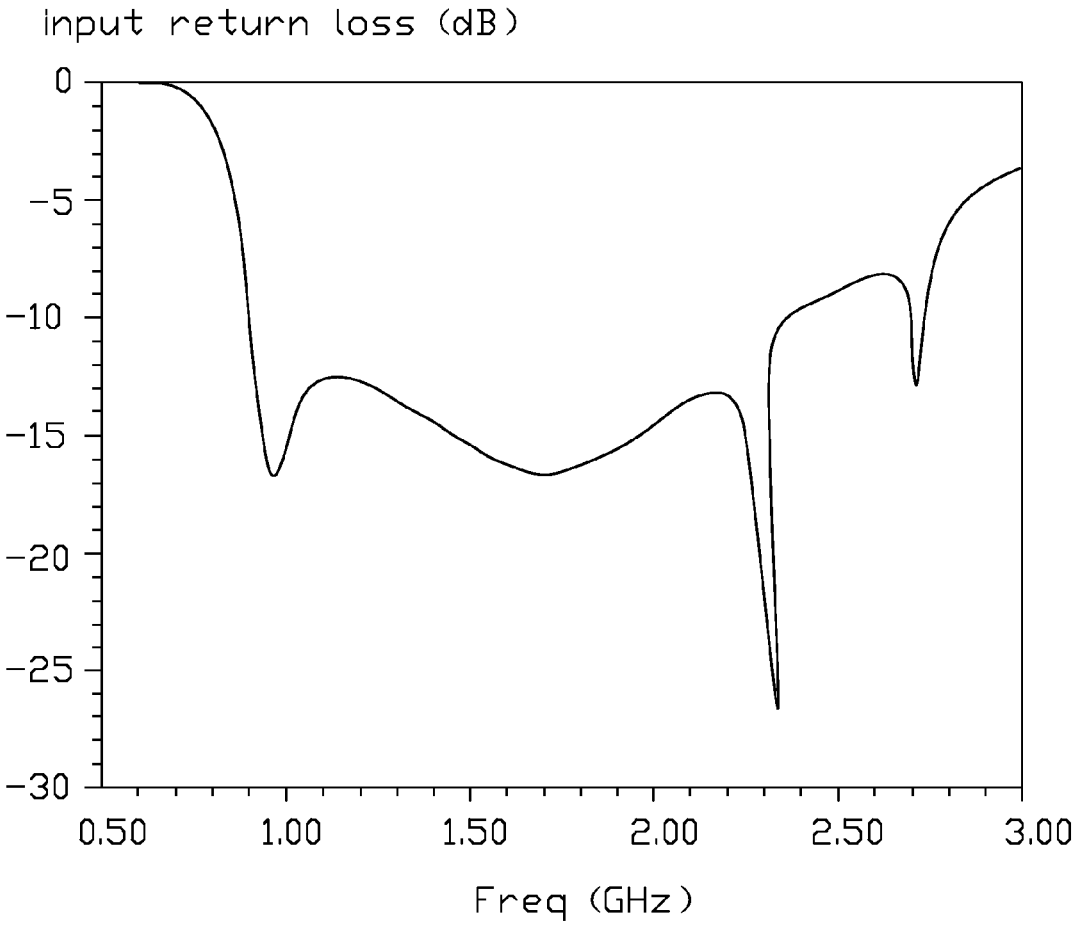
FIG. 15 is a graph of test result showing an input return loss of the balun of FIG. 1.

In FIG. 15, an input return loss of the balun 100 is below −20 dB, when the balun 100 covers radio frequency bands between 0.95 GHz-2.15 GHz.

Figure 16:
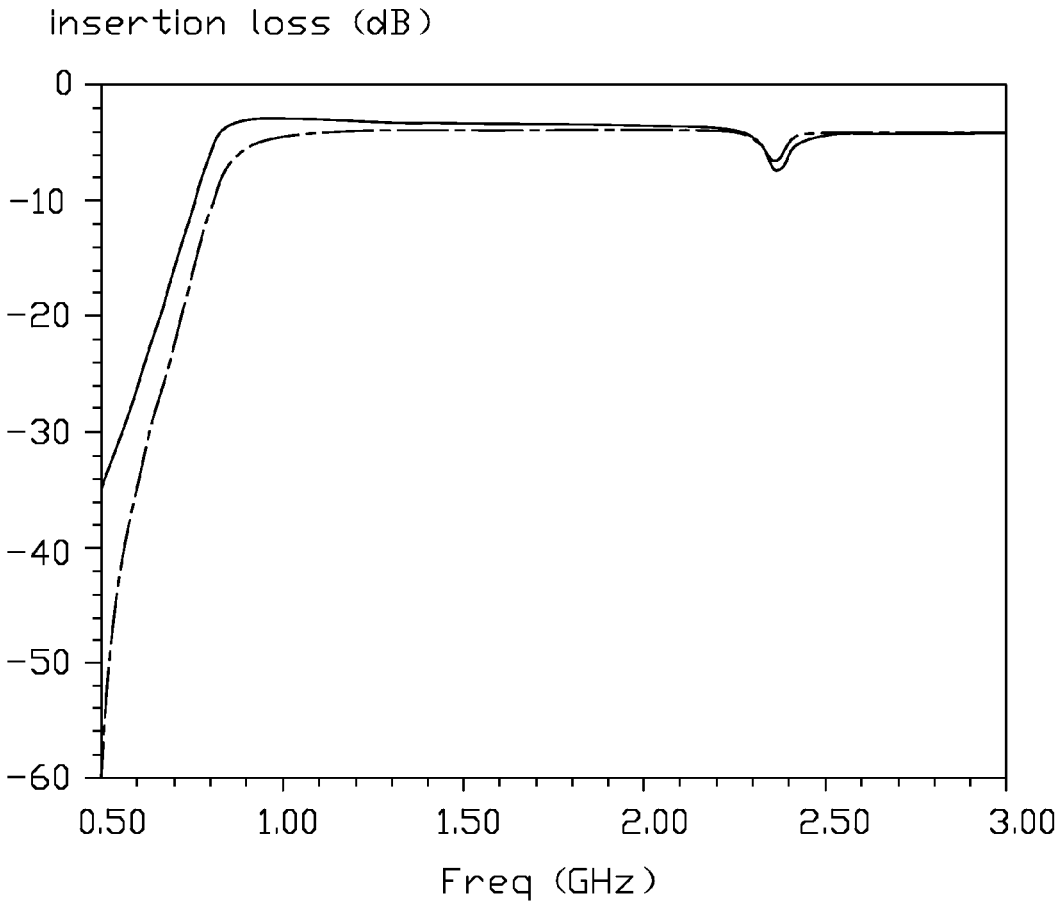
FIG. 16 is a graph of test results showing insertion losses of a first output port and a second output port of the balun of FIG. 1.

In FIG. 16, insertion losses of a first output port 40 and a second output port 50 of the balun 100 are shown. The insertion losses of a first output port 40 and a second output port 50 are greater than −5 dB, when the balun 100 covers radio frequency bands between 0.95 GHz-2.15 GHz.

Figure 17:
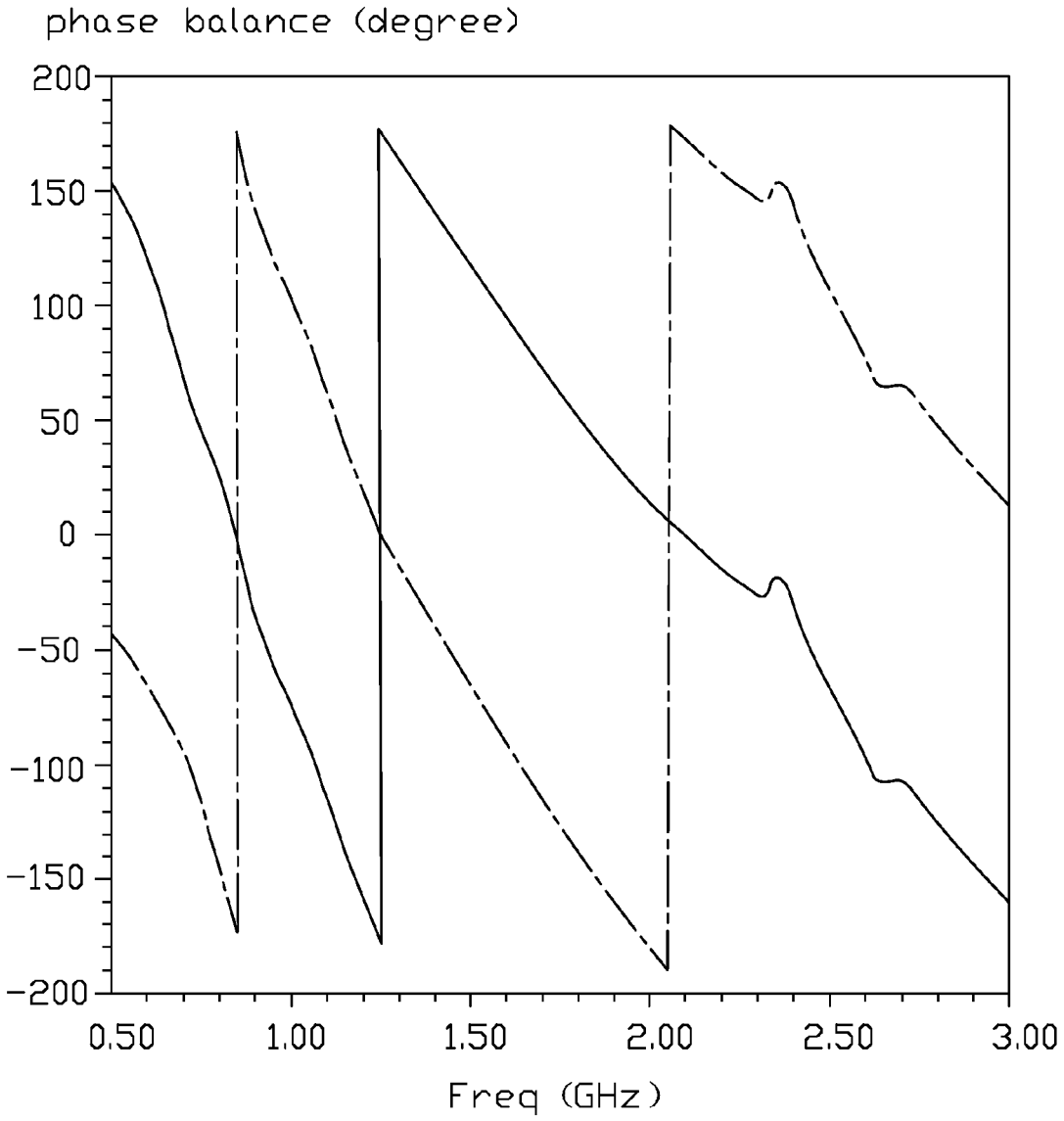
FIG. 17 is a graph of test results showing phase balance of a first output port and a second output port of the balun of FIG. 1.

In FIG. 17, a phase difference at the first output port 40 and the second output port 50. The phase difference between the first output port 40 and the second output port 50 are all close to 180 degrees, when the balun 100 covers radio frequency bands between 0.95 GHz-2.15 GHz. Therefore, the balun 100 has a good balanced input and output signal.

Figure 18:
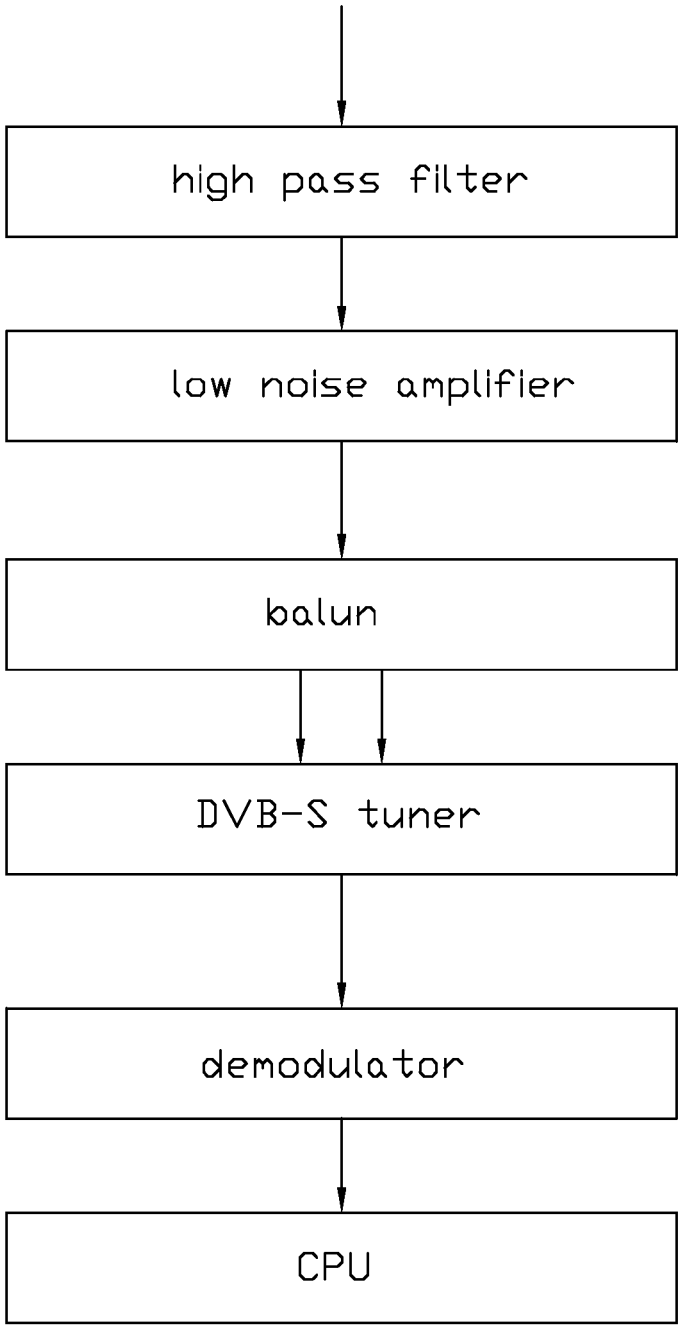
FIG. 18 is a schematic plan view of a hardware design of a communication apparatus including the balun in accordance with the present disclosure.

FIG. 18 is a schematic plan view of a hardware design of a communication apparatus including the balun 100 in accordance with the present disclosure. The communication apparatus includes a high pass filter, a low noise amplifier, a DVB-S tuner, a demodulator and a CPU. A Radio Frequency (RF) signal is filtered by passing through the high pass filter, and enlarged by passing through the low noise amplifier. The RF signal after being enlarged is an unbalanced signal. Then, the unbalanced signal is transformed to two balanced signals. The DVB-S tuner receives and processes the two balanced signals and output a signal to the demodulator. Finally, the demodulator transmits a TV signal to the CPU.

The balun 100 is printed on the substrate 10 and not protruding from the substrate 10. The balun 100 has a small size and low cost.

While various embodiments and methods of the present disclosure have been described above, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A balun printed on a substrate, comprising:

an input port operable to input an unbalanced signal;

a first output port operable to output a first balanced signal;

a second output port operable to output a second balanced signal; and a coupling microstrip group, operable to transform the unbalanced signal into the first balanced signal and the second balanced signal, the coupling microstrip group comprising an input line connected to the input port, a first output line connected to the first output port, a first coupling line, a second output line connected to the second output port and a second coupling line, wherein the input line comprises a first coupling section connected to the input port, a second coupling section opposite to the first coupling section, and a connecting section connected between the first coupling section and the second coupling section;

the first output line and the first coupling line being respectively located at two sides of the first coupling section, one end of the first coupling line electrically connected to the first output line, the second output line and the second coupling line being respectively located at two sides of the second coupling section, one end of the second coupling line electrically connected to the second output line;

the unbalanced signal being transformed into the first balanced signal via coupling among the first coupling section, the first output line and the first coupling line; the unbalanced signal being transformed into the second balanced signal via coupling among the second coupling section, the second output line and the second coupling line.

2. The balun of claim 1, wherein the first output line, the second output line, the first coupling line and the second coupling line are grounded.

3. The balun of claim 2, wherein the substrate comprises a first surface and a second surface, the input port, the first output line, the second output line, the first coupling line, the second coupling line, the first output port and the second output port are coplanar with each other and printed on the first surface.

4. The balun filter of claim 3, further comprising a first connecting part and a second connecting part formed on the second surface and close to the connecting section of the input line, wherein the first connecting part is operable to be electrically connected to the first coupling line and the first output line, and the second connecting part is operable to be electrically connected to the second coupling line and the second output line.

5. The balun of claim 3, wherein the input port is located at one side of the coupling microstrip group, and the first and second output ports are located at the other side of the coupling microstrip group, the first output line and the second output line are respectively located at two opposite sides of the input line, the first coupling line and the second coupling line are located between the first coupling section and the second coupling section.

6. The balun of claim 5, wherein the first coupling line, the first output line and the first coupling section are parallel with each other, and the second coupling line, the second output line and the second coupling section are parallel with each other.

7. The balun of claim 3, wherein the first surface of the substrate comprises a ground layer and a clearance area which is an insulative area surrounded by the ground layer, the input port, the coupling microstrip group, the first output port and the second output port are arranged in the clearance area, the first output line, the second output line, the first coupling line and the second coupling line extend from the ground layer into the clearance area.

8. The balun of claim 2, wherein the first coupling section comprises a first straight portion adjacent and connected to the input port, a first wandering portion and a second straight portion connecting with each other in turn, the second coupling section comprises a third straight portion, a second wandering portion and a fourth straight portion connecting with each other in turn, the second straight portion and the third straight portion are adjacent and connected to the connecting section, the fourth straight portion comprises a free end formed away from the connecting section, the first wandering portion is opposite to the fourth straight portion, the second wandering portion is opposite to the second straight portion.

9. The balun of claim 8, wherein the first straight portion and the second straight portion are collinear, and the third straight portion and the fourth straight portion are collinear, the second straight portion and the third straight portion are parallel with each other and perpendicular to the connecting section.

10. The balun of claim 1, further comprising an input matching circuit formed between the input port and the input line and operable to improve an input return loss for obtaining a better stability for the balun.

11. The balun of claim 10, wherein the input matching circuit comprises a first capacitor, a second capacitor and an inductor, the first capacitor and the second capacitor are connected with each other in series and located between the input port and the input line, one end of the inductor is connected between the first capacitor and the second capacitor, the other end of the inductor is connected to a ground layer formed on the substrate.

12. The balun of claim 1, wherein the first output port comprises a first connecting end, a first output capacitor, a first middle section and a first output section in turn, the first connecting end is connected to the first output line, the second output port comprises a second connecting end, a second output capacitor, a second middle section and a second output section in turn, the second connecting end is connected to the second output line, the first output capacitor and the second output capacitor are operable to improve insertion losses of the first output port and the second output port.

13. The balun of claim 12, wherein the first connecting end and the first middle section are collinear, and the first output section is perpendicular to the first middle section, the second connecting end and the second middle section are collinear, and the second output section is perpendicular to the second middle section.

14. The balun of claim 12, wherein the first output port is formed as L-shaped and mirror-symmetrical to the second output port.

* * * * *